US009714633B2

(12) United States Patent
Enters et al.

(10) Patent No.: US 9,714,633 B2
(45) Date of Patent: Jul. 25, 2017

(54) CONTROL VALVE

(71) Applicant: DELPHI INTERNATIONAL OPERATIONS LUXEMBOURG, S.A.R.L., Bascharage (LU)

(72) Inventors: Richard Denis Jacques Alain Enters, Vineuil (FR); David Bonneau, Blois (FR); Thierry Thibault, St. Ouen les Vignes (FR); Jean-Christophe Oge, Neuvy (FR); Philippe Legrand, St. Gervais la Foret (FR)

(73) Assignee: DELPHI INTERNATIONAL OPERATIONS LUXEMBOURG S.A.R.L., Luxembourg (LU)

( * ) Notice: Subject to any disclaimer, the term of this patent is extended or adjusted under 35 U.S.C. 154(b) by 183 days.

(21) Appl. No.: 14/373,656

(22) PCT Filed: Jan. 24, 2013

(86) PCT No.: PCT/EP2013/051347
§ 371 (c)(1),
(2) Date: Jul. 22, 2014

(87) PCT Pub. No.: WO2013/110710
PCT Pub. Date: Aug. 1, 2013

(65) Prior Publication Data

US 2014/0353537 A1 Dec. 4, 2014

(30) Foreign Application Priority Data

Jan. 26, 2012 (EP) ..... 12152743

(51) Int. Cl.
*F02M 63/00* (2006.01)
*F02M 61/04* (2006.01)
(Continued)

(52) U.S. Cl.
CPC ..... *F02M 61/042* (2013.01); *F02M 47/027* (2013.01); *F02M 61/12* (2013.01);
(Continued)

(58) Field of Classification Search
CPC .. F02M 55/04; F02M 61/16; F02M 2200/315; F02M 2200/40; F02M 2200/31
(Continued)

(56) References Cited

U.S. PATENT DOCUMENTS 7,066,397 B2 6/2006 Astachow et al.
2003/0051700 A1 3/2003 Ricco
(Continued)

FOREIGN PATENT DOCUMENTS

DE 2521339 A1 11/1976
DE 10 2007 013244 A1 9/2008
(Continued)

OTHER PUBLICATIONS

International Search Report dated Mar. 13, 2013.

*Primary Examiner* — Arthur O Hall
*Assistant Examiner* — Viet Le
(74) *Attorney, Agent, or Firm* — Joshua M. Haines

(57) ABSTRACT

The present invention relates to a control valve for a fuel injector. The control valve has a control valve body which defines a supply passage for high pressure fuel. A control chamber and a pressure compensating chamber are provided in the control valve. The control chamber and the pressure compensating chamber are both in fluid communication with the supply passage. A control valve member is provided for controlling fuel pressure in the control chamber. The pressure compensating chamber is spaced radially outwardly from the control chamber. The invention also relates to a control valve member having a pressure compensating cavity.

10 Claims, 9 Drawing Sheets

(51) Int. Cl.
*F02M 47/02* (2006.01)
*F02M 61/12* (2006.01)
*F02M 61/16* (2006.01)

(52) U.S. Cl.
CPC ..... *F02M 61/167* (2013.01); *F02M 63/0015* (2013.01); *F02M 63/0033* (2013.01); *F02M 63/0071* (2013.01); *F02M 63/0078* (2013.01); *F02M 2200/16* (2013.01)

(58) Field of Classification Search
USPC ..... 239/89–96; 251/48; 123/467
See application file for complete search history.

(56) References Cited

U.S. PATENT DOCUMENTS

| | | | | |
|---|---|---|---|---|
| 2003/0150930 | A1* | 8/2003 | Bauer | F02M 47/027 239/88 |
| 2005/0161536 | A1 | 7/2005 | Tojo et al. | |

FOREIGN PATENT DOCUMENTS

| | | | |
|---|---|---|---|
| DE | 10 2009 003145 | A1 | 11/2010 |
| JP | 2010-106693 | A | 5/2010 |
| WO | 01/02718 | A1 | 1/2001 |
| WO | 03/029642 | A1 | 4/2003 |
| WO | 2007/002787 | A1 | 1/2007 |

* cited by examiner

CONTROL VALVE

CROSS REFERENCE TO RELATED APPLICATIONS

This application is a national stage application under 35 U.S.C. 371 of PCT Application No. PCT/EP2013/051347 having an international filing date of 24 Jan. 2013, which designated the United States, which PCT application claimed the benefit of European Patent Application No. 12152743.6 filed 26 Jan. 2012, the entire disclosure of each of which are hereby incorporated herein by reference.

TECHNICAL FIELD

The present invention relates to a control valve for a fuel injector. The invention also relates to a control valve member for a control valve.

BACKGROUND OF THE INVENTION

A known fuel injector 1 will be described with reference to FIGS. 1, 2*a* and 2*b*. The injector 1 comprises an injector body 3 (sometimes referred to as a nozzle holder body), an injector nozzle 5 and a movably mounted injector needle 7. The injector nozzle 5 comprises a plurality of nozzle holes (not shown) which can be selectively opened and closed by the injector needle 7 to inject fuel into a combustion chamber (not shown). A spring 9 is provided in a spring chamber 11 for biasing the injector needle 7 towards a seated position in which the nozzle holes are closed.

The fuel injector 1 further comprises an equilibrium control valve 13 for controlling the injector needle 7. The control valve 13 comprises a control valve body 15 and a control valve member 17 mounted in a control chamber 19. The control valve member 17 comprises a guide barrel 21 and a stem 22 having a smaller diameter. A conical valve 23 is formed above the stem 22 for locating in a valve seat 24 formed in the control valve body 15 to close the control valve 13. An electro-mechanical solenoid 25 is provided to actuate the control valve member 17 and enable selective opening and closing of a low pressure fuel return line 27. A sidewall of the control chamber 19 forms a valve guide 29 for cooperating with the guide barrel 21 of the control valve member 17.

A fuel supply line 31 supplies fuel from a high pressure fuel pump (not shown) to the injector nozzle 5 and the spring chamber 11. The control chamber 19 is also in fluid communication with the fuel supply line 31 via a high pressure fuel passage 33.

When the control valve 13 is closed, there is no fluid communication between the spring chamber 11 and the low pressure fuel return line 27. Accordingly, the fuel pressure in the injector nozzle 5 and the spring chamber 11 equalises and the spring 9 biases the injector needle 7 to a seated position in which the nozzle holes are closed.

Conversely, when the control valve 13 is opened, a path is formed which places the spring chamber 11 in fluid communication with the low pressure fuel return line 27 resulting in a reduction in the fuel pressure in the spring chamber 11. The fuel pressure in the injector nozzle 5 is higher than the fuel pressure in the spring chamber 11 and a pressure force applied to the injector needle 7 overcomes the bias of the spring 9. The injector needle 7 lifts from its seated position and opens the nozzle holes allowing fuel to be injected into the combustion chamber, as shown in FIG. 1.

On a solenoid common rail injector, the control valve 13 plays an important part in controlling fuel leaks. A leak results in an energy loss and this has a direct effect on $CO_2$ emissions of a vehicle using the injector 1. In use, the fuel injector 1 will experience two forms of leaks:

a. Dynamic leaks—these are leaks which result from the opening of the control valve 13 during injection; and
b. Static leaks—these are leaks between the control valve member 17 and the valve guide 29 when the control valve 13 is closed and the fuel injector 1 is not injecting.

Static leaks are more significant since the control valve spends more time closed than it does open. Contributing factors in static leaks include: guide clearance; guide length; increased clearance for injector and engine assembly; and increased clearance due to pressure.

The static leaks within the control valve 13 due to pressure are particularly relevant in view of the continuing trend towards higher operating pressures (for example 2200 to 3000 bar) for fuel injected into the combustion chamber. The high pressure fuel within the control chamber 19 applies radial loading which can distort the control valve body 15. Similarly, radial loading is applied to the control valve member 17 which can cause it to distort. The distortion of the control valve body 15 and/or the control valve member 17 increases the clearance within the control valve 13 which can result in an increase in static leaks.

The pressure force gradient causes distortion of the control valve body 15, as illustrated by a first plot $P_1$ superimposed on the control valve 13 shown in FIG. 2A. The pressure force gradient acting on the stem 22 is illustrated by a second plot $P_2$ superimposed on the control valve 13 shown in FIG. 2B. The relative deflection along the length (mm) of the control valve body 15 and the control valve member 17 under pressure is shown in a graph in FIG. 3 (an enlarged view of the control valve body 15 and the control valve member 17 is shown alongside the graph). An initial clearance C between the control valve body 15 and the control valve member 17 increases to C' proximal the inlet of the high pressure fuel passage 33. The increased clearance caused by the working pressures in the control chamber 19 can cause higher static leaks in the control valve 13.

The present invention, at least in preferred embodiments, sets out to overcome or ameliorate at least some of the problems associated with prior art fuel injectors and control valves.

SUMMARY OF THE INVENTION

In a first aspect, the present invention relates to a control valve for a fuel injector, the control valve comprising: a control valve body; a supply passage for high pressure fuel; a control chamber and a pressure compensating chamber, the control chamber and the pressure compensating chamber both being in fluid communication with the supply passage; and a control valve member for controlling fuel pressure in the control chamber; wherein the pressure compensating chamber is spaced radially outwardly from the control chamber.

The pressure compensating chamber at least partially balances the pressure forces applied to the control valve body. Distortion of the control valve body can be reduced when high pressure fuel is introduced into the control chamber. Accordingly, increases in the clearances between the control valve body and the control valve member when the control valve is operating can be reduced. The present invention can thereby reduce static leaks from the control valve. The control valve can be used in a diesel fuel injector. The operating pressure of the fuel can be greater than 2000 bar, and could be greater than 3000 bar.

In use, the control valve member can travel between an open position and a closed position to control fuel pressure in the control chamber. The control valve member can be mounted in the control chamber. In particular, the control valve member can be movably mounted in the control chamber. The control valve member can comprise a guide barrel for cooperating with a sidewall of the control chamber. At least in certain embodiments, the pressure compensating chamber can reduce leakage past the control valve member. The control chamber can comprise a longitudinal axis and the control valve member can be movable along said longitudinal axis.

It will be appreciated that more than one pressure compensating chamber could be provided around the control chamber. Alternatively, the pressure compensating chamber can comprise an annular chamber. The annular chamber can extend partially or completely around the control chamber. The annular chamber can comprise first and second upper ends which are at least substantially sealed. The control chamber and the pressure compensating chamber can be arranged concentrically. The pressure compensating chamber can be disposed radially outwardly of the control chamber. This can help to balance pressure forces between the control chamber and the pressure compensating chamber. The control chamber can be maintained in direct fluid communication with the supply passage, or indirectly via the pressure compensating chamber. The pressure compensating chamber can be maintained in fluid communication with the supply passage.

The control chamber and the pressure compensating chamber can be maintained in fluid communication with each other. One or more apertures can be provided between the control chamber and the pressure compensating chamber. The control chamber and the pressure compensating chamber can be maintained in fluid communication with each other when the control valve member is in both said open position and said closed position.

A sleeve or an insert can be located in the control valve body to form the pressure compensating chamber and/or the control chamber. The control chamber can be formed inside the sleeve; and the pressure compensating chamber can be formed outside the sleeve. The pressure compensating chamber can be formed between an outer surface of the sleeve and an inner surface of a bore formed in the control valve body. The sleeve can be fixedly mounted to the control valve body. The interface between the sleeve and the control valve body can be sealed to reduce or avoid static leaks. The sleeve can be a restriction fit in the control valve body. Alternatively, or in addition, at least one high pressure seal can be formed between the sleeve and the control valve body.

The sleeve can be an interference fit in a bore formed in the control valve body. One or more bearing surfaces can be provided to form a seal between the control valve body and the sleeve. The one or more bearing surfaces can be formed in the bore for engaging the sleeve; and/or formed in the sleeve for engaging the bore. The one or more bearing surfaces can be annular, for example forming an annular projection. First and second bearing surfaces can be formed in said control valve body for engaging said sleeve; and/or first and second bearing surfaces can be formed on said insert for engaging said control valve body. The first and second bearing surfaces can have different diameters. For example, the first bearing surface can have a larger diameter than the second bearing surface. The first bearing surface can be disposed above the second bearing surface. This arrangement can facilitate location of the sleeve in the control valve body.

The sleeve can guide the control valve member as it travels between said open and closed positions. The guide barrel of the control valve member can cooperate with the sleeve to guide the control valve member. A circumferential recess can be formed in the control valve member and/or the sleeve. The circumferential recess forms an annular region which can be arranged concentrically with the pressure compensating chamber. An inlet for introducing high pressure fuel to the control chamber can open into the circumferential recess.

An inner surface of the sleeve can form a seal with the control valve member. The insert can define a valve seat for the control valve. The valve seat can, for example, comprise a truncated conical surface for cooperating with a tapered section of the control valve member.

In a further aspect, the present invention relates to a control valve member for controlling fuel pressure in a control chamber, the control valve member comprising a pressure compensating cavity for communicating with a high pressure fuel supply. By allowing high pressure fuel to enter the pressure compensating cavity within the control valve member, the pressure forces which could distort the control valve member can be reduced.

A plurality of pressure compensating cavities could be formed, for example defined by longitudinal bores each operatively in fluid communication with the high pressure fuel supply. The pressure compensating chamber could be an annular chamber or a cylindrical chamber. The pressure compensating cavity can extend along a longitudinal axis of the control valve member.

The pressure compensating cavity can be a cylindrical bore arranged concentrically with an outer cylindrical surface of the valve member. In use, this configuration can help to provide uniform pressure balancing forces.

The pressure compensating cavity can extend at least partially along a guide portion and/or a stem of the control valve member.

The pressure compensating cavity can have a first end and a second end. The first end of the pressure compensating cavity can comprise at least one aperture for communicating with the high pressure fuel supply. The second end of the pressure compensating cavity can be sealed, for example by a plug.

The present invention relates to a fuel injector comprising a control valve as described herein; and/or a control valve member as described herein. The control valve and the control valve member described herein can be used independently of each other or in combination.

In a further aspect, the present invention relates to an injector nozzle for a fuel injector, the injector nozzle comprising: a supply passage for high pressure fuel; an injector chamber for an injector needle; the injector nozzle further comprising a pressure compensating chamber; wherein the pressure compensating chamber is spaced radially outwardly from the injector chamber. The pressure compensating chamber and the injector needle are in fluid communication with the supply passage.

In a still further aspect, the present invention relates to an injector needle for a fuel injector, the injector needle comprising a pressure compensating cavity for communicating with a high pressure fuel supply.

The terms top and bottom used herein are with reference to the orientation of the fuel injector shown in the accompanying drawings and are not intended to be limiting on the scope of the invention.

BRIEF DESCRIPTION OF THE DRAWINGS

Embodiments of the present invention will now be described, by way of example only, with reference to the accompanying figures, in which.

DETAILED DESCRIPTION OF AN EMBODIMENT

Figure 1:
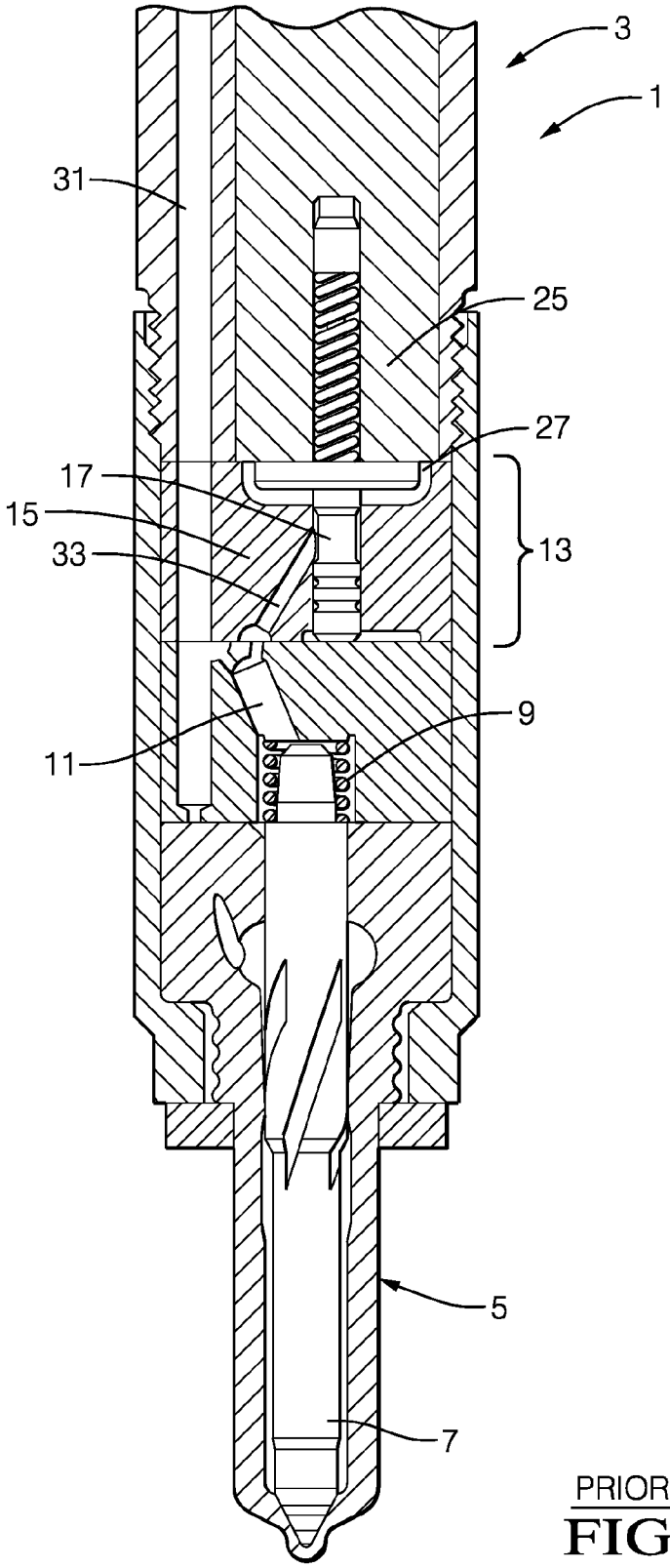
PRIOR ART FIG. 1
FIG. 1 shows a prior art fuel injector.
Figure 2A:
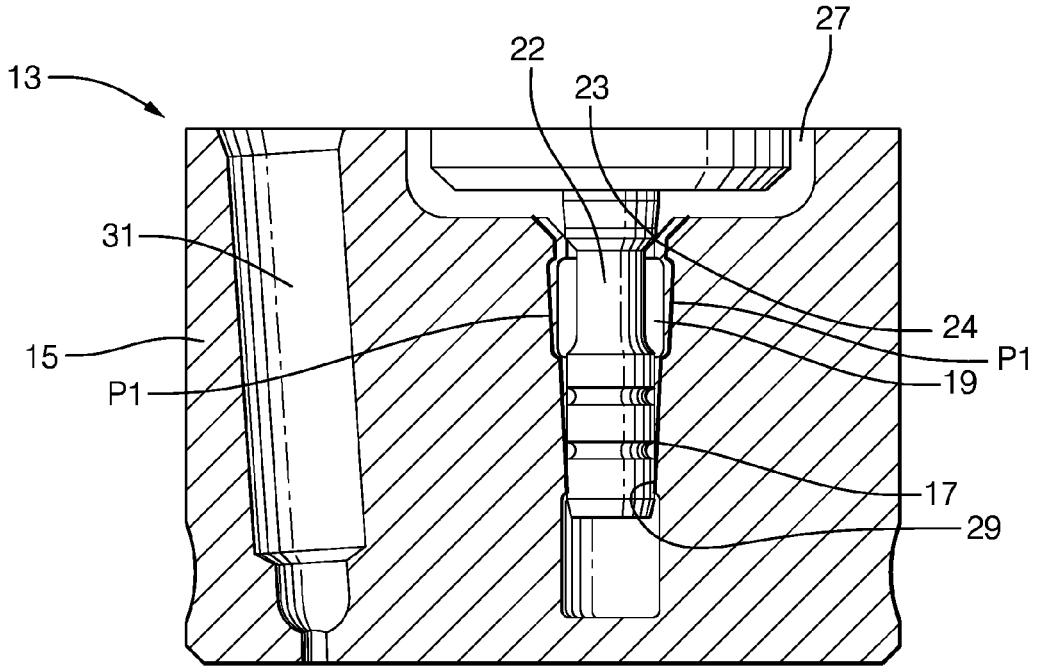
FIGS. 2A and 2B illustrate the pressure force gradients created in a control valve of the prior art fuel injector shown in FIG. 1.
Figure 2B:
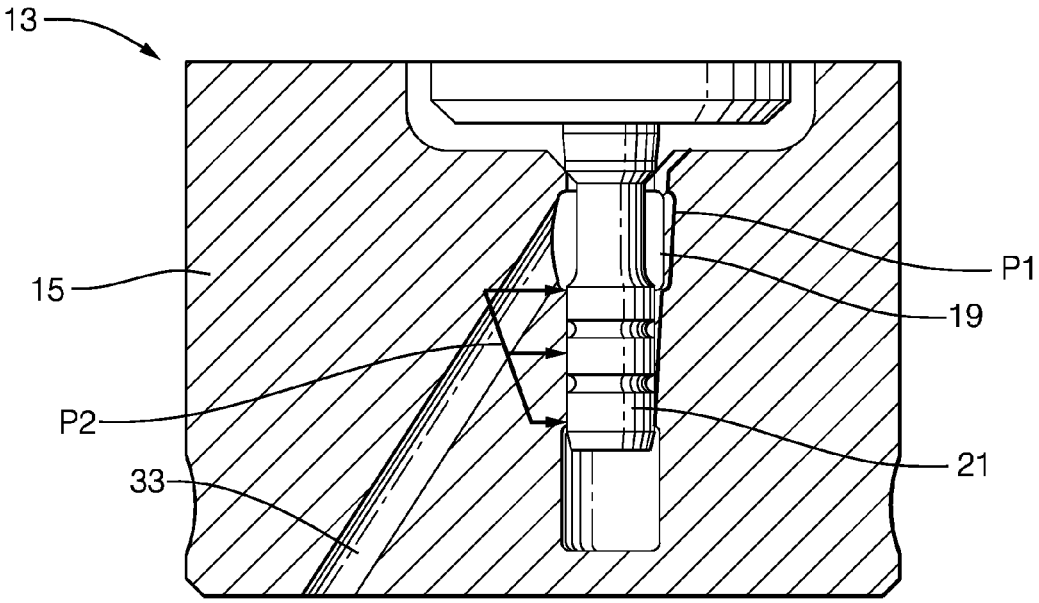
Figure 3A:
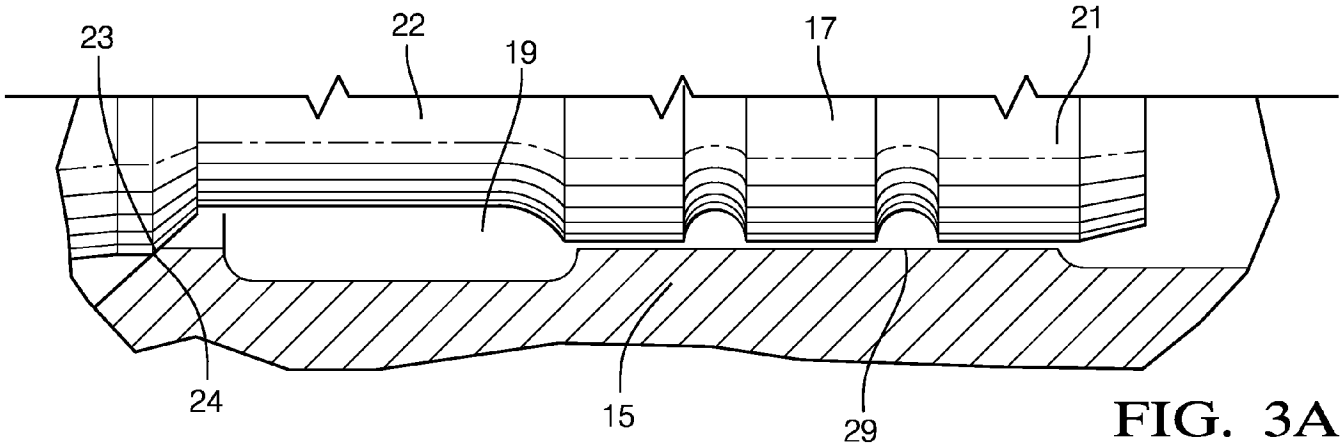
FIG. 3 shows the operating clearance between the control valve body and the control valve member of the control valve shown in FIG. 2.
Figure 3B:
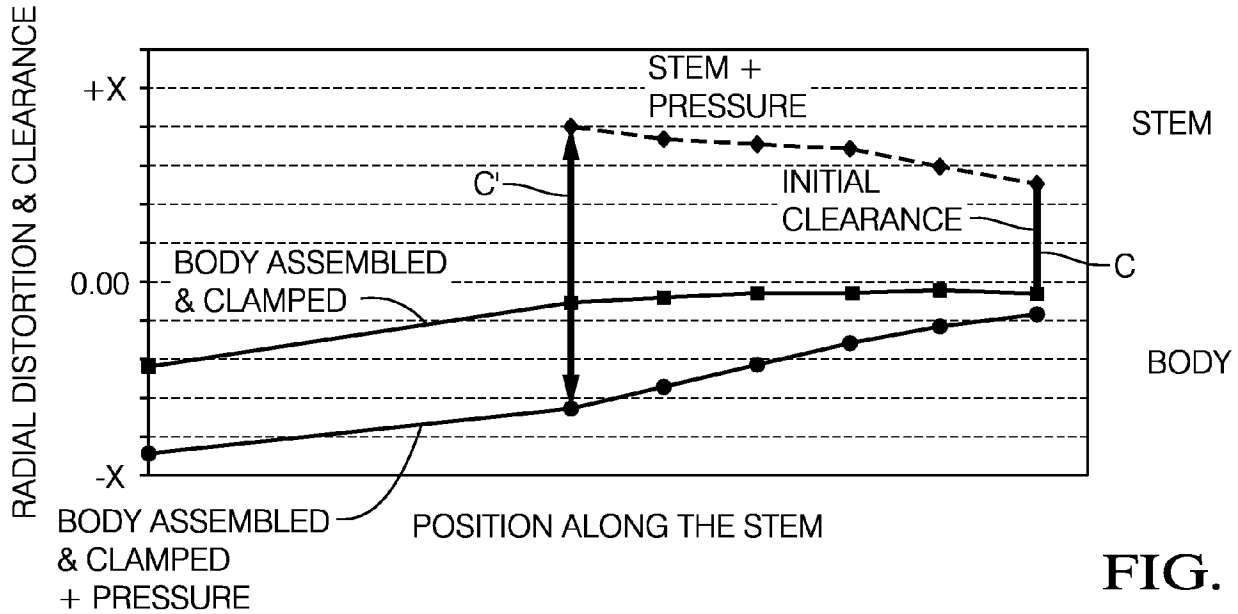
Figure 4:
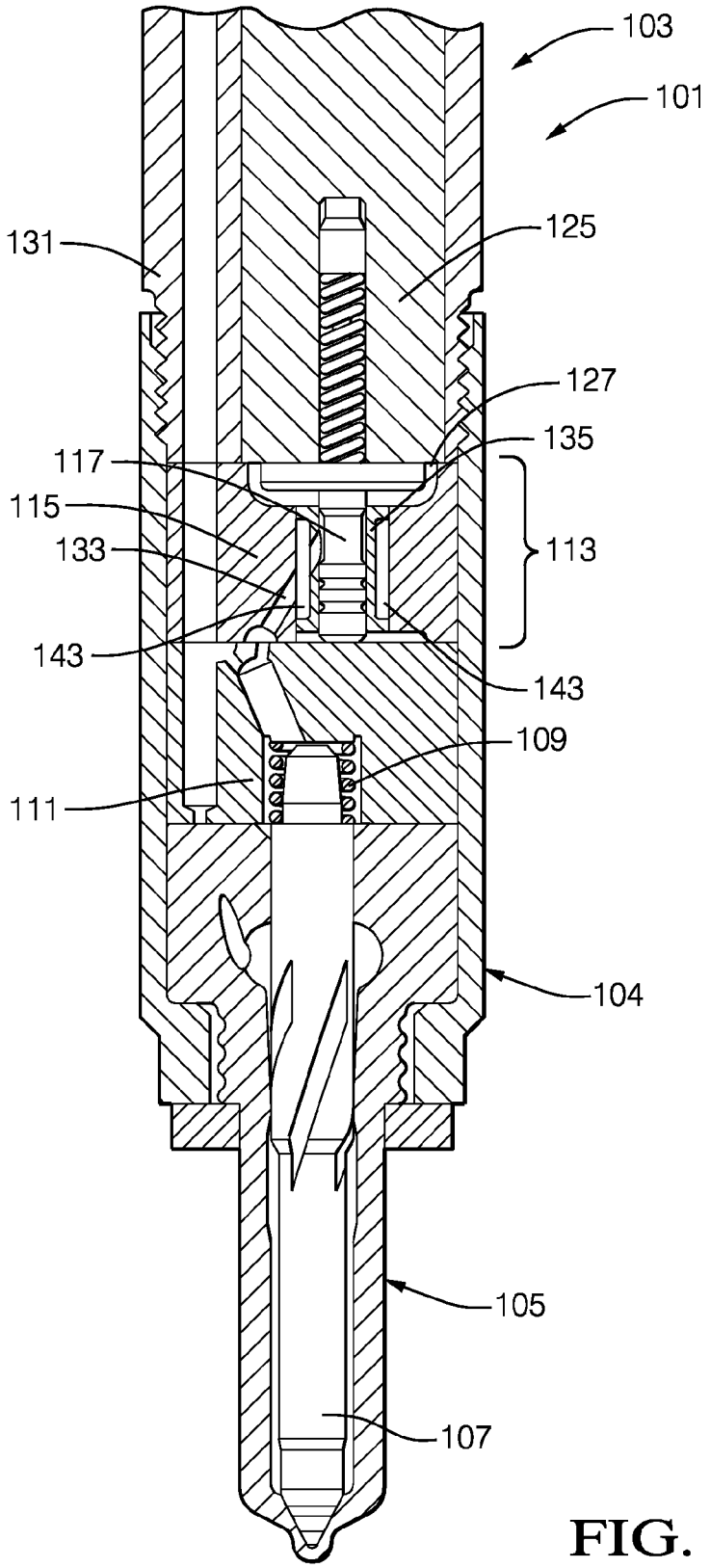
FIG. 4 shows a fuel injector according to a first embodiment of the present invention.

A fuel injector 101 in accordance with the present invention will now be described with reference to FIGS. 4 to 6. The fuel injector 101 has particular application in diesel fuel injector systems. The operation of the fuel injector 101 is generally the same as the prior art fuel injector 1 described herein and the description will focus on the pressure compensating features which are the subject of the present invention.

The fuel injector 101 comprises an injector body 103 (also referred to as a nozzle holder body), a nozzle body 104, an injector nozzle 105 and a movably mounted injector needle 107. The injector nozzle 105 comprises a plurality of nozzle holes (not shown) which can be selectively opened and closed by the injector needle 107 to inject fuel into a combustion chamber (not shown). A spring 109 is provided in a spring chamber 111 for biasing the injector needle 107 towards a seated position in which the nozzle holes are closed.

Figure 5:
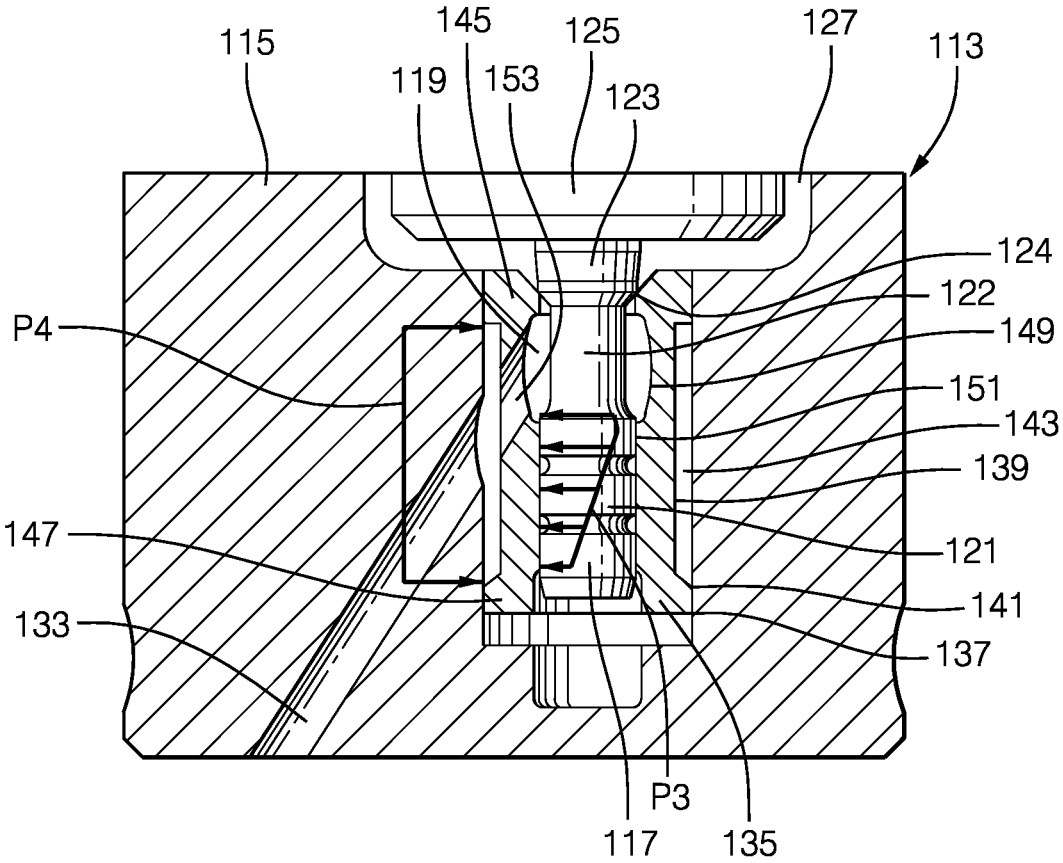
FIG. 5 shows a pressure compensating control valve according to the present invention.

The fuel injector 101 further comprises a control valve 113, as illustrated in FIG. 5. The control valve 113 comprises a control valve body 115; and a control valve member 117 mounted in a cylindrical control chamber 119. The control valve member 117 comprises a guide barrel 121, a stem 122 and a conical valve 123. An electro-mechanical solenoid 125 actuates the control valve member 117 and, thereby, controls communication between a high pressure fuel passage 133 (which is in fluid communication with a fuel supply line 131) and a low pressure fuel return line 127.

The sidewall of the control chamber 119 is defined by a cylindrical insert 135 which is located in a bore 137 formed in the control valve body 115. The top of the cylindrical insert 135 also defines a valve seat 124 for receiving the conical valve 123 of the control valve member 117. When the conical valve 123 is seated in the valve seat 124, the control valve 113 is closed and fluid communication between the control chamber 119 and the low pressure return line 127 is inhibited.

An outer annular recess 139 is formed in an outer surface 141 of the insert 135 to form a pressure compensating chamber 143 which remains in fluid communication with the high pressure fuel passage 133. The outer annular recess 139 defines top and bottom flanges 145, 147 which are a restriction fit in the bore 137 to sealing mount the insert 135. An inner annular recess 149 is formed in an inner surface 151 of the insert 135 coincident with the stem 122 of the control valve member 117 to form the control chamber 119. An aperture 153 is formed in the insert 135 to maintain fluid communication between the pressure compensating chamber 143 and the control chamber 119. In the present embodiment, the aperture 153 is inclined relative to a longitudinal axis of the insert 135 to form a continuation of the high pressure fuel passage 133.

The pressure compensating chamber 143 and the control chamber 119 are arranged concentrically, with the pressure compensating chamber 143 spaced radially outwardly of the control chamber 119. The pressure compensating chamber 143 is in direct fluid communication with the high pressure fuel passage 133. The control chamber 119 is in indirect fluid communication with the high pressure fuel passage 133 via the aperture 153 formed in the insert 135.

The aperture 153 maintains fluid communication with the result that the pressure is uniform between the control chamber 119 and the pressure compensating chamber 143. In use, the forces resulting from the high pressures in the control chamber 119 are balanced by the forces generated in the pressure compensating chamber 143. The pressure force gradient generated in the control chamber 119 is represented by a third plot $P_3$ in FIG. 4. The corresponding pressure force gradient generated in the pressure compensating chamber 143 is represented by a fourth plot $P_4$. The pressure compensating chamber 143 thereby serves to reduce distortion of the control valve member 117 and the control chamber 119. The static leaks from the control valve 113 according to the first embodiment can be reduced.

Figure 6:
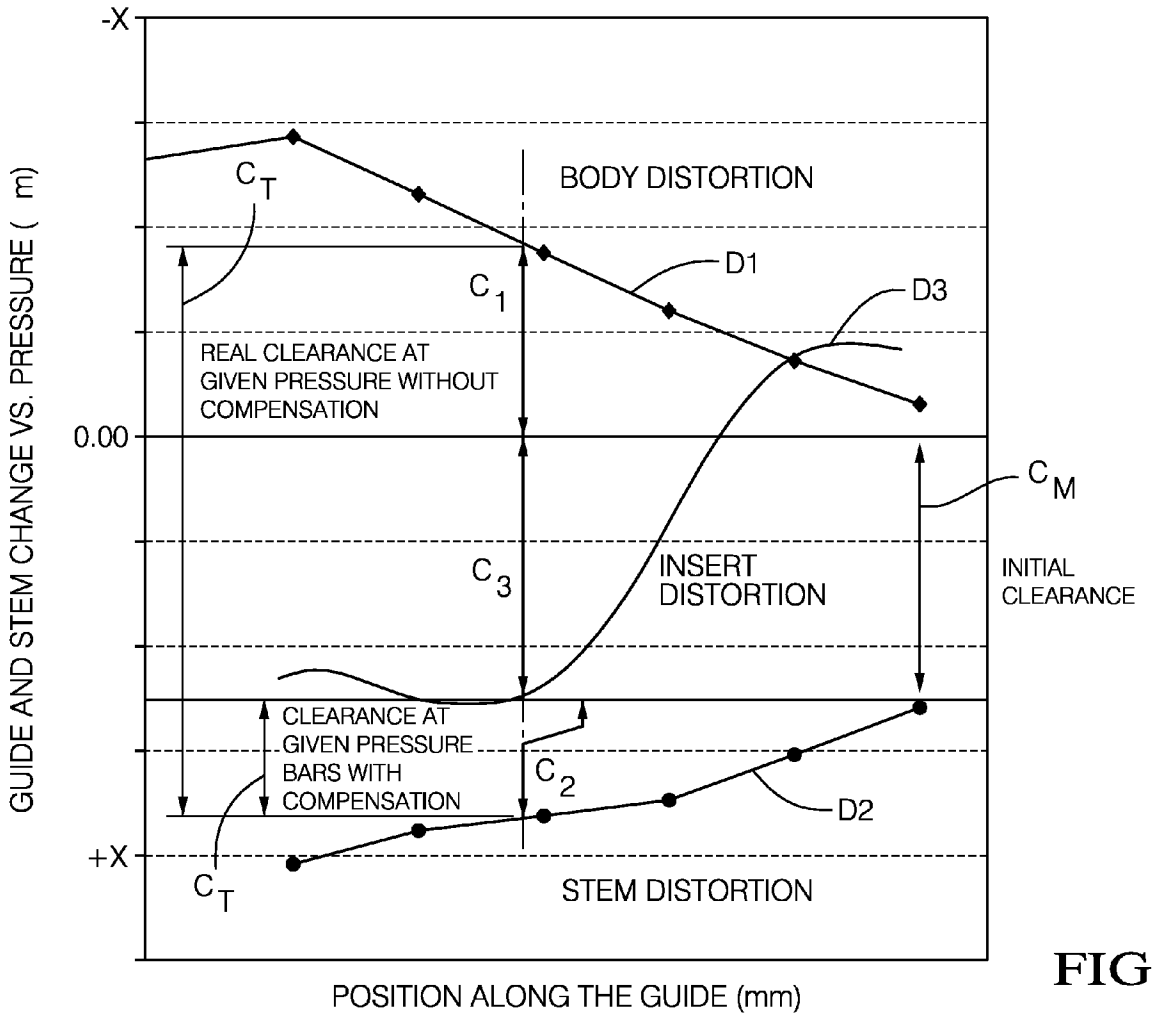
FIG. 6 shows the operating clearance between the control valve body and the control valve member of the control valve according to the present invention.

A graph showing the relative distortion of the control valve body 115, the stem 123 and the insert 135 along their length (mm) for a constant operating pressure of 2200 bar is shown in FIG. 6. The distortion of the control valve body 115 is represented by a first distortion plot $D_1$; the distortion of the stem 123 is represented by a second distortion plot $D_2$; and the distortion of the insert 135 is represented by a third distortion plot $D_3$.

A manufacturing clearance $C_M$ is specified between the control valve body 115 and the stem 123 when the control valve 113 is not pressurised. In the prior art control valve 13 (which does not include a pressure compensating chamber 143), under normal operating conditions the introduction of high pressure fuel causes the diameter of the bore in the control valve body 15 to increase by a first clearance $C_1$ and the diameter of the stem 23 to decrease by a second clearance $C_2$. Under operating conditions, the total clearance $C_T$ between the control valve body 15 and the stem 23 is given by the equation $C_T=C_M+C_1+C_2$. In contrast, with the compensating chamber 143, changes in the diameter of the bore in the control valve body 115 do not alter the clearance with the stem 123. Moreover, the introduction of high pressure fuel into the pressure compensating chamber 143 decreases the diameter of the insert 135 by a third clearance $C_3$. Accordingly, under operating conditions, the total clearance $C_{T'}$ between the stem 123 and the insert 135 is given by the equation $C_{T'}=C_M+C_2-C_3$. In practice, the third clearance $C_3$ may be approximately the same as the manufacturing clearance $C_M$ so that the total clearance $C_{T'}$ is substantially equal to the reduction in diameter of the stem 123. It will be appreciated that increasing the operating pressure of the fuel will reduce the total clearance $C_{T'}$ between the stem 123 and the insert 135. It will be appreciated that the operation of the fuel injector 101 is the same as that of the prior art fuel injector 1 described herein.

Figure 7:
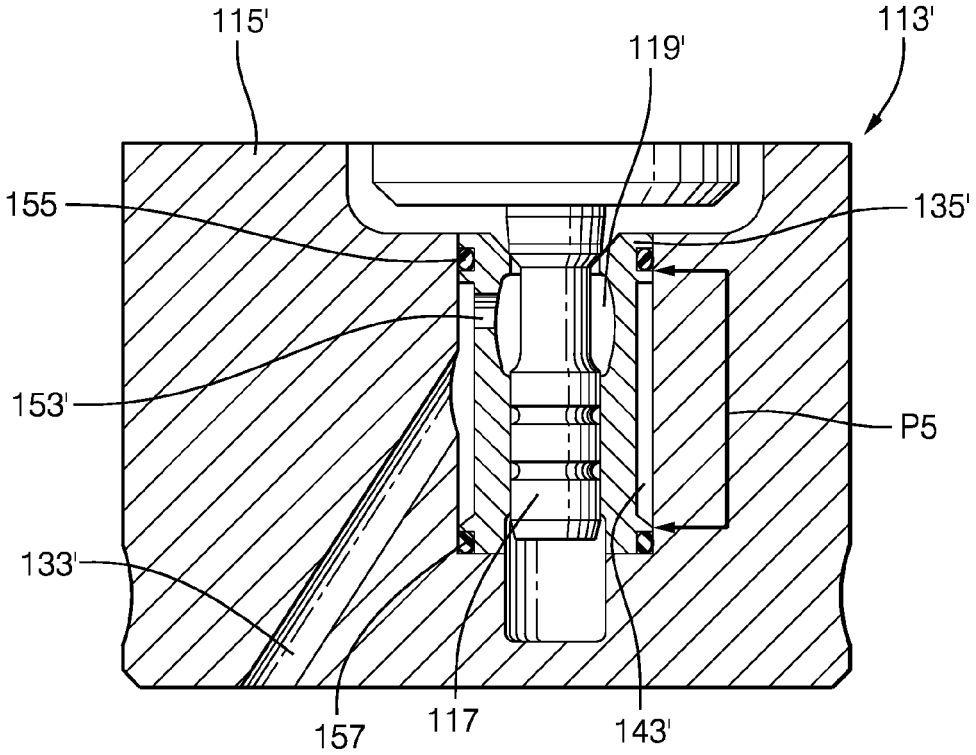
FIG. 7 shows a first modified version of the control valve according to the present invention shown in FIG. 5.

A first modified version of the control valve 113' according to the first embodiment of the present invention is illustrated in FIG. 7. Like reference numerals are used for like components, albeit suffixed with a modifier letter prime for clarity.

The control valve 113' comprises a modified insert 135' located in the bore 137' formed in the control valve body 115'. Rather than form an interference fit between the top and bottom flanges 145, 147 and the control valve body 115', top and bottom high pressure annular seals 155, 157 are formed to sealingly mount the insert 135. Furthermore, the aperture 153' in the modified insert 135' extends radially to maintain fluid communication between the control chamber 119' and the pressure compensating chamber 143'.

The operation of the first modified control valve 113' is unchanged from that of the first embodiment described above. The pressure force gradient generated in the pressure compensating chamber 143' is represented by a fifth plot $P_5$ in FIG. 7.

Figure 8:
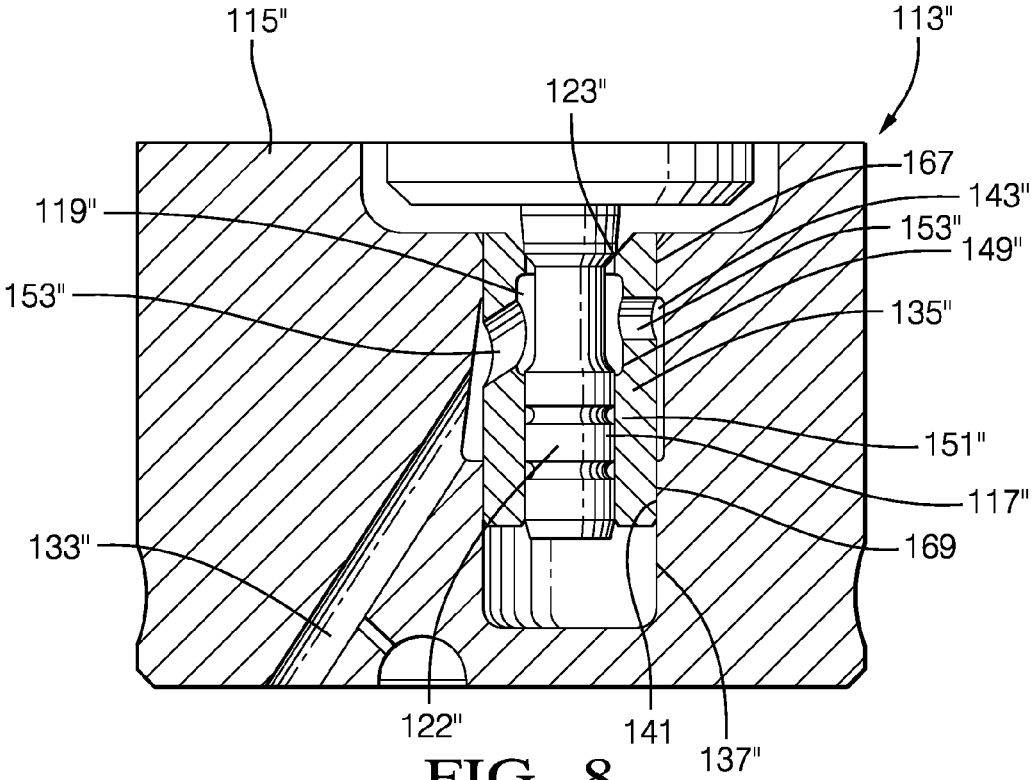
FIG. 8 shows a second modified version of the control valve according to the present invention shown in FIG. 5.

A second modified version of the control valve 113" according to the first embodiment of the present invention is illustrated in FIG. 8. Like reference numerals are again used for like components, albeit suffixed with two modifier letter primes for clarity.

The control valve 113" comprises an insert 135" located in a bore 137" formed in a control valve body 115"; and a control valve member 117" movably mounted within the insert 135". The insert 135" is a cylindrical sleeve which forms a control chamber 119". In the present arrangement, the insert 135" has an outer surface 141". The control valve member 117" comprises a guide barrel 121", a stem 122" and a conical valve 123". The stem 122" has a smaller diameter than the guide barrel 121". An inner annular recess 149" is formed in an inner surface 151" of the insert 135", coincident with the stem 122" of the control valve member 117", to form an annular region between the control valve member 117" and the insert 135". The operation of the control valve member 117" is unchanged from that of the first embodiment described herein.

A pressure compensating chamber 143" is formed concentrically around the insert 135" and is maintained in fluid communication a high pressure fuel passage 133". First and second apertures 153" are formed in the insert 135" coincident with the annular region formed between the control valve member 117" and the stem 122" of the insert 135". The first and second apertures 153" maintain fluid communication between the pressure compensating chamber 143" and the control chamber 119". Thus, the control chamber 119" is maintained in fluid communication with the high pressure fuel passage 133" via the pressure compensating chamber 143". In use, the fuel pressure is the same in both the control chamber 119" and the pressure compensating chamber 143", thereby balancing pressure forces acting on the insert 135".

A first (top) bearing surface 167 and a second (bottom) bearing surface 169 are formed in the bore 137". The first and second bearing surfaces 167, 169 are annular projections which extend radially inwardly. The insert 135" is an interference fit with the first and second annular bearing surfaces 167, 169. The first and second bearing surfaces 167, 169 secure the insert 143" in position axially by virtue of friction and said interference fit. Moreover, the first and second bearing surfaces 167, 169 define the top and bottom respectively of the pressure compensating chamber 143". The first and second bearing surfaces 167, 169 sealingly engage the outer surface 141" of the insert 135" to seal the pressure compensating chamber 143". A gluing and/or bonding operation can optionally also be performed to enhance the seal and/or fixed mounting of the insert 143".

To facilitate assembly of the control valve 113", the diameter of a bottom seal formed between the insert 135" and the control valve body 115" can be smaller than the diameter of a top seal formed between the insert 135" and the control valve body 115". In this arrangement, the first and second bearing surfaces 167, 169 have different diameters. The first bearing surface 167 has a larger diameter than the second bearing surface 169 to facilitate insertion of the insert 135". This arrangement facilitates location of the insert 135" in the control valve body 114" without causing damage to the first bearing surface 167. The outer surface 141" of the insert 135" can be profiled to match the different diameters of the first and second bearing surfaces 167, 169. For example, the outer surface 141" of the insert 135" can be tapered towards its bottom end to form a conical profile. Alternatively, the outer surface 141" could comprise third and fourth bearing surfaces (not shown) for engaging the first and second bearing surfaces 167, 169.

The operation of the second modified control valve 113" is the same as the first embodiment described above.

The second modified version of the control valve 113" has been described as having first and second apertures 153" to maintain fluid communication between the pressure compensating chamber 143" and the control chamber 119". It will be appreciated that a single aperture 153" could be provided or more than two apertures 153" provided. For example, up to ten (10) of said apertures 153" could be provided to maintain fluid communication.

Figure 9:
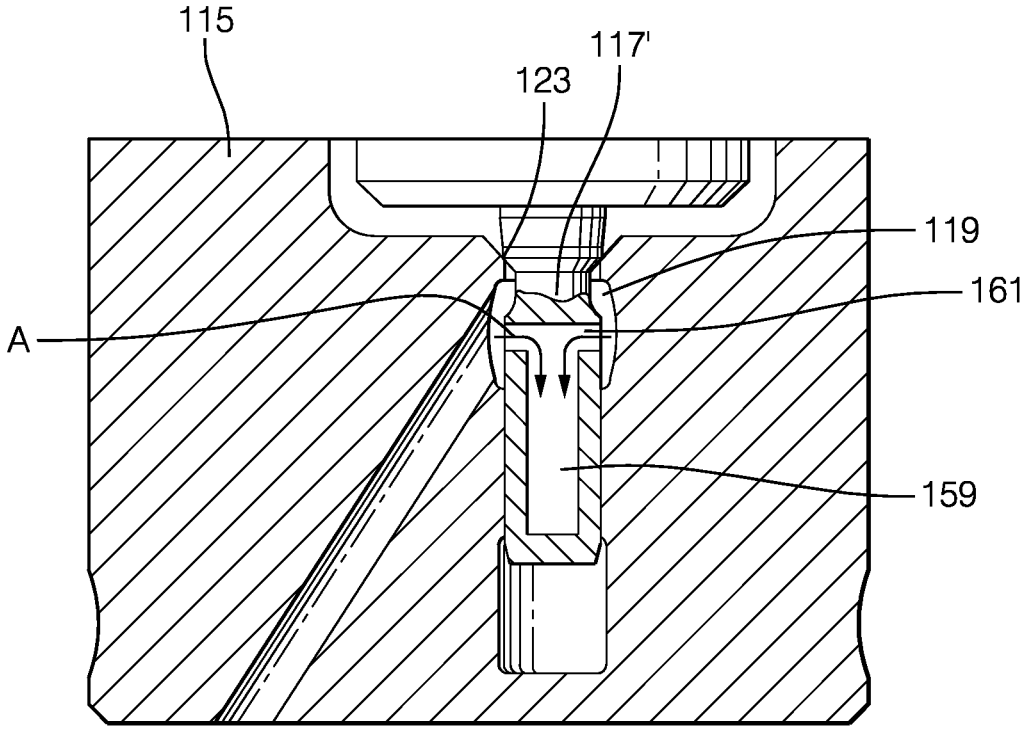
FIG. 9 shows a modified pressure compensating control valve member according to the present invention.

The pressure compensating technique described herein for offsetting the pressure applied to the control valve body 115 can also be employed in the control valve member 117. A modified control valve member 117' is illustrated in FIG. 9. A pressure compensating cavity 159 is formed inside the control valve member 117' for communicating with the control chamber 119 via an inlet passage 161. The pressure compensating cavity 159 extends along a longitudinal axis X of the control valve member 117 and the inlet passage 161 extends transversely. The pressure compensating cavity 159 can be formed by drilling the control valve member 117 and inserting a plug (not shown). Alternatively, the control valve member 117 could comprise a hollow cylinder fitted onto the control valve stem 123.

In use, high pressure fuel enters the control chamber 119 from the high pressure fuel passage 133 and fills the pressure compensating cavity 159, as illustrated by the arrows A. The resulting pressure force within the control valve member 117 acts radially outwardly to balance the pressure force applied on an exterior of the control valve member 117. The pressure compensating cavity 159 can thereby help to reduce distortion of the control valve member 117. The pressure compensating cavity 159 is placed in fluid communication with the low pressure return line 127 only when the control valve 113; 113' is open.

Although the pressure balancing cavity has been illustrated as extending downwardly through the guide barrel 121 of the control valve member 117, it could also extend upwardly to the conical valve 123 of the control valve member 117.

The control valve 113 and the control valve member 117 have been described with reference to a particular type of fuel injector 101, but it will be understood that they could be provided in combination or independently in other types of fuel injector.

Figure 10:
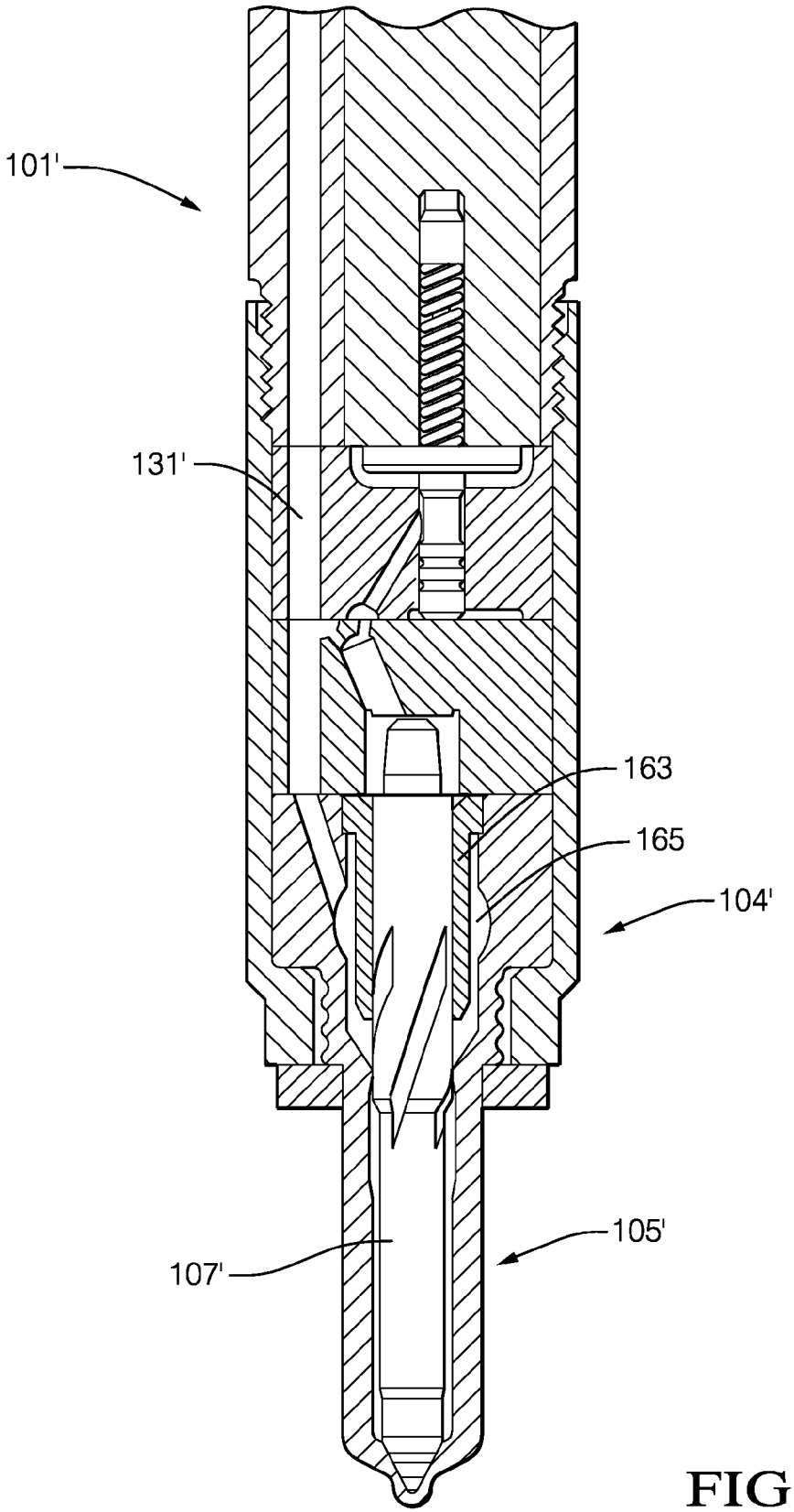
FIG. 10 shows a modified version of the injector nozzle according to the present invention.

The pressure compensating techniques described herein could have other applications. For example, a pressure compensating chamber could be provided in the injector nozzle 105. A modified version of the fuel injector 101 according to the first embodiment of the present invention is shown in FIG. 10. Like reference numerals will be used for like components, again suffixed with a modifier letter prime to aid clarity.

A cylindrical nozzle insert 163 is provided in the injector nozzle 105' to define a nozzle pressure compensating chamber 165. The nozzle insert 163 is arranged concentrically with the injector needle 107' and forms a seal around the injector needle 107'. The nozzle pressure compensating chamber 165 is located between the nozzle insert 163 and the nozzle body 104' and remains in fluid communication with the fuel supply line 131'. The nozzle pressure compensating chamber 165 thereby reduces deformation of the nozzle body 104' around the injector needle 107'. The seal around the injector needle 107' can be maintained during normal operating conditions. The nozzle insert 163 can also provide improved guidance of the injector needle 107' as it travels within the injector nozzle 105'.

Alternatively, or in addition, a pressure compensating cavity could be provided in an injector needle 107. These modifications (separately or in combination) could improve guiding of the injector needle 107 under pressure and reduce floating of the injector needle 107 when it reaches the seat.

It will be appreciated that various changes and modifications can be made to the control valve and the control valve member described herein without departing from the scope of the present invention.

The invention claimed is:

1. A control valve for a fuel injector, the control valve comprising:

a control valve body;

a supply passage for high pressure fuel; a control chamber and a pressure compensating chamber, the control chamber and the pressure compensating chamber both being in fluid communication with the supply passage such that the supply passage communicates high pressure fuel to the control chamber and to the pressure compensating chamber;

a low pressure fuel return line;

and a control valve member mounted in the control chamber which selectively prevents fluid communication between the control chamber and the fuel return line and between the pressure compensating chamber and the low pressure fuel return line and which selectively permits fluid communication between the control chamber and the fuel return line and between the pressure compensating chamber and the low pressure fuel return line for controlling fuel pressure in the control chamber;

wherein the pressure compensating chamber is spaced radially outwardly from the control chamber.

2. A control valve as claimed in claim 1, wherein the pressure compensating chamber comprises an annular chamber.

3. A control valve as claimed in claim 1, wherein the control chamber and the pressure compensating chamber are arranged concentrically.

4. A control valve as claimed in claim 1, wherein the control chamber is in fluid communication with the supply passage via the pressure compensating chamber.

5. A control valve as claimed in claim 1 further comprising a sleeve located in the control valve body, the pressure compensating chamber being formed between an outer surface of the sleeve and the control valve body.

6. A control valve as claimed in claim 5, wherein the sleeve is a restriction fit in the control valve body; and/or at least one high pressure seal is formed between the sleeve and the control valve body.

7. A control valve as claimed in claim 5, wherein an inner surface of the sleeve forms a seal with the control valve member.

8. A fuel injector comprising a control valve as claimed in claim 1.

9. A control valve as claimed in claim 1, wherein the control chamber and the pressure compensating chamber are both in fluid communication with the supply passage when the control valve member is closed.

10. A control valve as claimed in claim 1, wherein the control chamber and the pressure compensating chamber are both in fluid communication with the supply passage regardless of the position of the control valve member.

* * * * *